United States Patent [19]

Day

[11] 4,323,821

[45] Apr. 6, 1982

[54] LUMINAIRE CONVERTER

[75] Inventor: Thomas J. Day, Jefferson City, Mo.

[73] Assignee: Central Electrical Company, Fulton, Mo.

[21] Appl. No.: 116,966

[22] Filed: Jan. 30, 1980

[51] Int. Cl.[3] ..... H05B 39/10; H05B 41/46

[52] U.S. Cl. ..... 315/87; 315/92; 315/205; 315/DIG. 7

[58] Field of Search ..... 307/252 N; 315/DIG. 5, 315/DIG. 7, DIG. 2, 205, 239, 289, 92, 86, 87, 88

[56] References Cited

U.S. PATENT DOCUMENTS

| | | | |
|---|---|---|---|
| 3,401,265 | 9/1968 | Dotto | 315/205 X |
| 3,889,152 | 6/1975 | Bodine, Jr. et al. | 315/205 |
| 3,896,369 | 7/1975 | Nakata | 307/252 N |
| 3,900,763 | 8/1975 | Turner | 315/DIG. 7 |
| 3,917,976 | 11/1975 | Nuckolls | 315/DIG. 5 |
| 4,005,336 | 1/1977 | Casella | 315/239 |
| 4,072,878 | 2/1978 | Engel et al. | 315/205 |
| 4,092,564 | 5/1978 | Soleau | 315/DIG. 7 |
| 4,194,143 | 3/1980 | Farkas et al. | 315/239 |

*Primary Examiner*—Saxfield Chatmon, Jr.
*Attorney, Agent, or Firm*—Paul M. Denk

[57] ABSTRACT

A converter circuit for use in changing a series wired primary ballast normally employed for operating a mercury vapor lamp to a more energy-efficient high intensity discharge lamp, such as a high pressure sodium lamp, with the circuitry involved incorporating the series type ballasts that usually have operating characteristics for operating a 400 watt and a 175 watt lamp, with the secondary of each ballast comprising isolated neutral secondary winding. These are primary loop series wired ballasts which are controlled by regulators of a constant current type and dimensioned for operating at a 2400 volts ac open circuit voltage class functioning at 60 Hz. The converter circuit can be connected into a previously installed lamp fixture by incorporating it into its secondary circuit, of the series ballast, with the said converter circuit comprising a silicon controlled rectifier switching circuit and a trigger circuit to provide the necessary direct current pulse train for operation of the aforesaid high pressure sodium type lamp.

10 Claims, 4 Drawing Figures

LUMINAIRE CONVERTER

BACKGROUND OF THIS INVENTION

This invention relates generally to luminaire circuitry, and more specifically to a conversion circuit that may be incorporated into an existing lighting fixture for changing the type of light rendered operational by the same while substantially effecting a reduction in the energy consumed during the converted lamp's performance.

During the 1950's, communities became more concerned with enhancing the illumination of their streets during the evening and night hours, such mainly being necessitated due to the significant rise in the percentage of crimes perpetrated after dark. In addition, the safety of the pedestrian was foremost in such community action, and to attain some enhanced lighting, the usual type of incandescent bulb employed prior to said time was replaced by the rather improved mercury type vapor lamp that had come into production. Many of these series circuit operated vapor lamps are still in existence and in operation in the various municipalities.

Today's expense of converting a series primary loop to a parallel circuit and the installation of new ballasts to accompany the new and more energy efficient HPS lights is cost prohibitive for most municipalities. This converter invention was developed as a low cost alternative for retrofitting in the field with existing series luminaires and yields, as the embodiment of this application will show, benefits of energy economics comparable to new fixtures with the same HPS lamps are presently marketed.

As is known, the sodium vapor lamp is an arc discharge type of device having a gas confined to an arc tube surrounded by a glass envelope which produces illumination in response to electric potential and current through the ionizing gas contained within the said tube. Ionization must be initially brought about in order for illumination to commence. In addition, and by way of example, the mercury lamp type circuit for each light usually employs a 400 watt series ballast in its operation, and after it has been operating for some time, it consumes a driving voltage of 132 volts ac at 3.2 amps of current. Hence, the wattage or power consumed for operation of this type of lamp, in this example, is somewhere in the vicinity of 400–425 watts. This is a rather high wattage consumption for the circuit, and during this day and age, energy conservation has now become a necessity, and means must be provided for reducing the needless use of energy where such can be accomplished.

The current invention achieves by way of conversion of such earlier circuitry to one that can accommodate the lesser energy consuming high pressure type sodium lamp that utilizes much less wattage in its operation, frequently as much as forty percent or more for a lamp that can produce the equivalent foot-candles of illumination.

Various prior art patented circuitries have been available for furnishing illumination for such a lamp, but in most of these instances, they are circuitry that is for use in the original equipment market for initial installation and for accommodating lamps such as the high intensity discharge lamp, but which circuitry cannot function as a conversion means for replacing any earlier style less efficiently operating lamp of the type previously analyzed. Three such prior art devices are shown in the U.S. patent to Owens, et al., U.S. Pat. No. 4,037,148, and the two U.S. patents to Soileau, U.S. Pat. Nos. 4,092,564 and 4,069,442. These types of circuitry have generally been devised for meeting the starting and operating requirements for high pressure sodium lamps in an economical manner, and various electronic circuits are shown in the same but which have been proposed for parallel primary circuitry only. These devices work in combination with parallel ballasts of either the transformer type or the reactor type to generate the required operating current and voltage. And, further by way of reference, the aforesaid Owens patent discloses the use of a ballast controlled circuit which incorporates a triac and a triggering circuit and for use for regulating the power supply to a high intensity discharge lamp, but, as can be seen from reviewing its Triac circuitry, and its trigger circuit, the identified electronic components are much more complex for regulating their power supply output for the type of lamp being illuminated, and in addition, are for use principally for parallel primary circuits only. Also, it would appear that the electronic controls as set forth in this prior art disclosure are more for providing ballast control, as its name indicates, rather than acting as a particular converter for use in changing the current and voltage output from a series connected luminaire ballast that previously energized the high energy consuming mercury vapor type lamp to one that may now accommodate the high intensity discharge type of lamp, such as the high pressure sodium device.

Somewhat equivalent to the foregoing prior type of ballast control circuitry is also shown in the two patents to Soileau, as previously identified, wherein the provided circuitry furnishes operation for the high pressure sodium type lamp, but its power supply is already capable of producing a direct current source, that applies the dc pulses to its lamp, rather than disclosing circuitry that is for use for conversion purposes, and that is for rectifying the alternating current output of the secondary of the ballast to a direct current charge that can operate such a high pressure sodium type lamp. To obtain such, the Soileau circuitry incorporates the usage of an SCR switch which charges the capacitor of the circuitry for obtaining a positive voltage substantially higher than the supply voltage of the circuitry, and thus, with this higher supply voltage there is attained an improved color property for the operating lamp's output. Hence, these Soileau patented devices are not designed for attaining circuitry conversion.

The U.S. patent to Bodine, U.S. Pat. No. 3,889,152, discloses an apparatus for operating a high pressure sodium lamp, but the circuitry described requires a neutral conductor in order to attain its functioning. In addition, this Bodine apparatus must operate in a circuit that is parallel with its illuminated lamp, while the current invention is intended to operate only with the series connected type of lamps. Essentially, it would appear that this prior art device is designed for providing a much higher starting voltage from a lamp ballast for igniting high intensity arc discharge lamps in the category of mercury lamps, sodium vapor lamps, and the like, and that it is primarily for use in parallel circuits, without necessitating the need for any rectification of its ballast produced secondary charge that needs conversion for operating the current type high pressure sodium lamp from the earlier installed series connected mercury vapor type circuitry. Various other prior art patents also disclose related type of circuitry, with the patent to Elms, U.S. Pat. No. 4,162,428, disclosing a variable inductance ballast apparatus for a high intensity discharge lamp, but not containing a circuitry that is in any way equivalent to that set forth in the current invention. In addition, the patent to Powell, U.S. Pat. No. 3,193,726, discloses an apparatus for operating electric discharge lamps that includes an impedance simulator.

In view of the foregoing, it would appear most pertinent that the principal object of the current invention is to provide means for conversion of the previously installed series connected luminaire circuitry to produce a pulsed direct current output that may operate the lesser energy consuming high intensity discharge lamps currently available upon the market.

Another object of this invention is to provide a rather compact size converter that may be conveniently inserted into the secondary output of the light's ballast for operating the high pressure sodium type lamp.

Still another object of this invention is to provide a converter unit that may be fabricated into a compact arrangement and encapsulated for immediate and facile insertion within existing lighting circuitry.

Still another object of this invention is to provide a converter means for substantially reducing the energy consumed, in kilowatt-hours per year, by a community for attaining effective street lighting.

Yet a further object of this invention is to provide a direct current pulse for igniting and sustaining the operations of a high pressure sodium lamp.

These and other objects will become more apparent to those skilled in the art upon reviewing this summary of this invention, and upon undertaking a study of the description of its preferred embodiment, in view of the drawings.

SUMMARY OF THE INVENTION

This invention contemplates the conversion of the existing mercury vapor type of street lighting circuitry, usually of the series wired type, for its accommodation of the much lesser energy consuming high intensity discharge type lamp that can produce an equivalent amount of lighting during normal operation.

The lamp conversion circuitry of this invention, with the recommended lamp change from the mercury vapor to the high pressure sodium type luminaire, and being properly installed in a series primary wired ballast of the existing type street lighting, effectively reduces the operating wattage for each light as converted by at least forty percent for a near equal amount of illumination on or at the street surface. Thus, the savings effected from utilizing the converting concept of this invention substantially reduced the energy consumption on an annualized basis for each street light converted by at least such forty percent.

Normally there are two types of mercury vapor fixture type of series ballasts that provide for the operation of the 400 watt and 175 watt mercury vapor type lamps. These performances are normally attained from isolated neutral secondary windings. And, the primary loop of such circuitry incorporates series wired ballasts which are normally controlled by regulators of a constant current type of 2400 volts ac upon an open circuit voltage class at 60 Hz frequency, as aforesaid. To attain a conversion of these existing type fixtures, the current invention incorporates a converter circuitry that may be connected directly into the output circuit lines of the secondary of such ballast. The converter incorporates a silicon controlled rectifier, being arranged within one circuit line of the ballast secondary, with the single SCR disclosed as a directionally controlled switch and having a single capacitor joined across its cathode and anode terminals, for filtering purposes. To attain firing of the rectifier, a trigger diode is arranged in series with a resister, and each of these are maintained parallel to the anode of the SCR, and more specifically, being connected to the terminal on the gate lug of the SCR. Thus, through the operations of this type of converter circuitry, the alternating current output of the ballast secondary is converted to a pulsating dc, having a high initial current output in order to attain that ionization of the high pressure sodium lamp as required for its operation.

As known, a threshold ignition current is required to commence ionization of the high pressure sodium type lamp on a series wired primary ballast. At the instance the proper current is flowing through the arc tubes, the electric resistance builds within the arc tube and illumination begins to increase. The voltage of a pulsating dc type is created across the lamp terminals and begins to build, and the line current to the lamp eventually begins to decrease. Within a matter of minutes, from the initial ionization of the lamp, the illumination output of the lamp is at a maximum level and the operating wattage of the ballast will remain stable for such continuous operation until that time as the power supply feeding the ballast is turned off. More specifically, and as can be seen from the following chart, the operations of a 400 watt mercury vapor lamp utilize a low voltage and current requirement, but that when sustained operation of the lamp is produced, the wattage consumed is in the vicinity of 400–425 watts.

| | 400 WATT MV | |
|---|---|---|
| Time | Volts | Amps |
| Int | 46 | 1.1 |
| 1 min | 48 | 1.9 |
| 5 min | 132 | 3.2 |
| 10 min | 138 | 3.0 |
| 12 min | 138 | 3.0 |
| | 150 WATT HPS | |
| Time | AC Volts | AC Amps |
| Int | 26 | 5.2 |
| 1 min | 46 | 4.3 |
| 2 min | 53 | 2.7 |
| 3 min | 90 | 1.7 |
| 4 min | 90 | 1.7 |

In the alternative, and as can be seen from the operational data derived for the 150 watt high pressure sodium lamp, while its initial wattage may be above that required to attain ignition for the aforesaid mercury vapor lamp, once the sodium lamp is fully ignited, and operating, its wattage consumption is somewhat in the vicinity of 150 watts. And, what is more significant, and as will be subsequently disclosed, the light produced from these two lamps is equivalent for lighting purposes meaning that an energy savings can be made of at least 40%, and in this particular example, the energy efficiency, or that energy saved, is within the vicinity of 60%.

The conversion of the lamp ballast can be made in a manner that allows the usage of any of a variety of high intensity discharge lamps within its socket. For example, a 150 watt, 100 watt, or 70 watt lamp may be employed, and the converting characteristic within this circuitry is determined by the size of the resistance used within the trigger and circuitry for the silicon controlled rectifier. By increasing this resistance, a greater wattage consuming lamp can be employed.

To show the equivalent operations between the mercury vapor and the high pressure sodium type lamp, the following chart discloses the lamp operating circuitry when the converter has been properly installed to allow usage of the sodium lamp, and the measured wattage required for operating each lamp in order to give or provide the equivalent foot-candles light output during such comparative operations. For example, comparison is made between the 400watt mercury vapor lamp and the 150 watt high pressure sodium lamp, and it can be seen that the measured consumed wattage for these two luminaires is substantially reduced for the sodium lamp, but at the same time, the measured foot-candles of light projected at street surface is equivalent. Similar type comparison can be made between the 175 watt mercury vapor lamp, with respect to the 100 watt high pressure sodium lamp. Likewise, a similar type comparison is made between the same mercury vapor lamp, and the 70 watt high pressure sodium lamp.

| Conversion | Measured Watts | Foot-Candles* |
|---|---|---|
| 400W MV | 415 | 2.50 |
| to | reduced to | to |
| 150W HPS | 182 | 2.50 |
| 175W MV | 180 | 1.25 |
| to | reduced to | to |
| 100W HPS | 102 | 1.56 |
| 175W MV | 180 | 1.25 |
| to | reduced to | to |
| 70W HPS | 82 | 1.25 |

*measured at street surface from Class II 35' poles

DESCRIPTION OF THE PREFERRED EMBODIMENT

Figure 1:
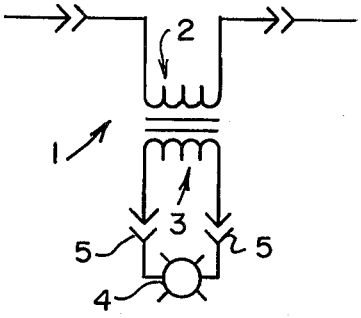
FIG. 1 discloses the series wired primary ballast for the existing mercury vapor lamp.

In the drawings, and more particularly referring to FIG. 1, there is disclosed the usual series ballast connected circuitry for the standard mercury vapor type of luminaire, with the ballast 1 having its primary 2 interconnected with its secondary 3 and having the usual Mogul or other lamp socket 4 connected therewith by means of the separable electrical connectors 5. Normally, and as previously summarized, the open circuit primary voltage is usually somewhere in the vicinity of 2400 volts ac, and through the ballast is capable of operating the standard 400 watt or 175 watt mercury vapor lamp. In addition, the amperage through the primary is generally in the vicinity of 6.6 amps maximum.

Figure 2:
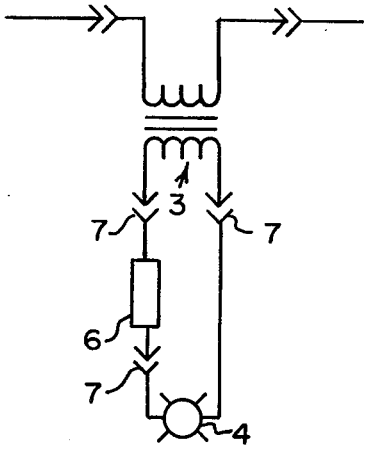
FIG. 2 provides a circuit diagram showing the lamp conversion unit where installed within the secondary winding of the series wired ballast.
Figure 3:
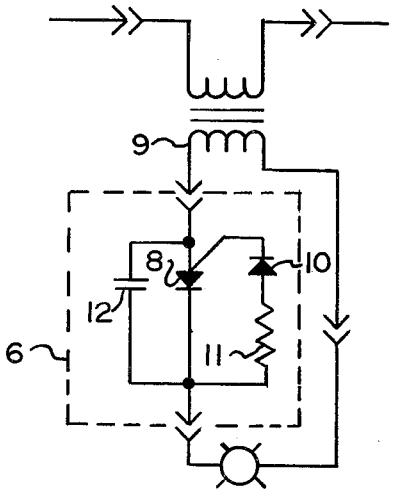
FIG. 3 discloses the specific electrical circuitry for the conversion unit disclosed connected within the secondary for the series wired ballast.

As can be seen in FIG. 2, the series wired primary ballast has connected within its secondary 3 the lamp converter unit 6 of this invention. Separable electrical connectors 7 facilitate the insertion of this conversion unit into the circuit lines of the secondary. More specifically, as can be seen in FIG. 3, the conversion unit 6 incorporates a silicon controlled rectifier (SCR) 8 within the circuit line 9 of the secondary, and connected with the gate lug of the SCR is the trigger diode 10 as shown. This trigger diode has operating characteristics generally selected at between 1 to 40 milliamps of current, at 0.5 to 3.0 volts. In addition, the SCR is selected to operate within a 200 to 400 volt cathode to anode operational range, at 1 to 20 amps input. The gate for the SCR is designed to operate within a range of 1 to 40 milliamps, at a voltage of 0.5 to 3.0 volts.

Connected in series with the trigger diode is a resistor 11, and which is generally selected between 1.75 megaohms to 5.0 megaohms. More specifically, it has been found that selecting the resistance value of approximately 5 megaohms for this resistor allows the 150 watt high pressure sodium lamp to be operated with a 400 watt series connected ballast. In addition, selecting a resistor having a 3.5 megaohms value allows the 100 watt high pressure sodium lamp to be used in conjunction with the 175 watt series connected ballast. Furthermore, selecting a 1.75 megaohms resistance for that resistor 11 within the circuitry allows the 70 watt high pressure sodium lamp to be operated with the 170 watt series connected ballast. Thus, depending upon the value of the resistance selected, the size of the high intensity discharge lamp will be determined.

Connected in parallel with the SCR is a capacitor 12 and which is joined across the cathode and anode terminals for the SCR. The capacitor selected in the preferred embodiment is one that can operate up to 200 volts dc, having approximately a capacitance of 0.04 to 0.06 microfarads, and more specifically approximately 0.05 microfarads when operating. The purpose for this capacitor is to function as a filter for the voltage wave form generated in the secondary of the ballast, and as rectified by the SCR identified.

It may be commented that the SCR of this invention may be replaced by what is identified in the trade as a Triac, and function to produce similar results to that desired from this invention. In addition, the lamp operating circuit, and more specifically the converter 6 identified herein, may be properly encased or encapsulated within some insulated material, and serve as a simple and economical conversion device for converting an existing series wired primary mercury vapor street luminaire to a more energy efficient high pressure sodium lamp fixture in the field with the simple addition of this device in the lamp circuit, and a mere changing of its lamps from the mercury type to the high intensity type, namely the high pressure sodium type.

Figure 4:
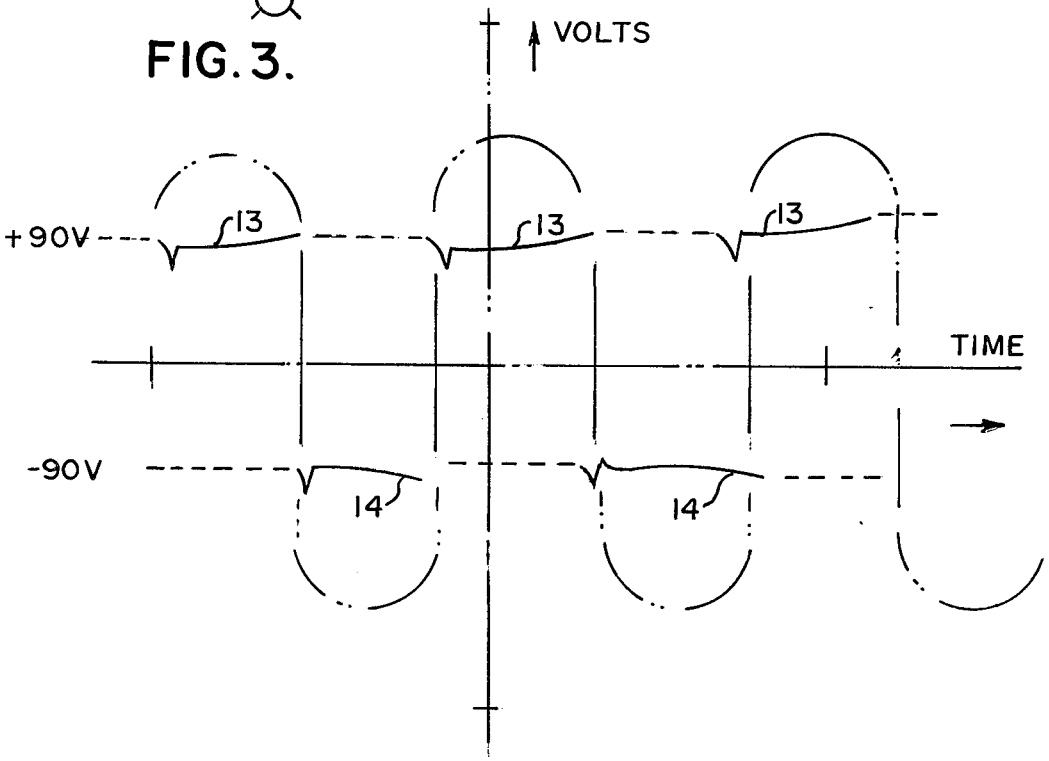
FIG. 4 furnishes a sketch of the oscilloscope image for the voltage wave form generated during operation of the converter unit of this invention.

As can be seen in FIG. 4, there is shown the wave form depicted upon the oscilloscope showing the rectified pulsating dc type voltage across the lamp terminals during the lamp operation. More specifically, the SCR rectifies the usual alternating current generated within the ballast secondary, and forms a pulsating type positive voltage, herein shown as 90 volts positive, with every other cycle of operation. This is shown at 13 within the wave form pattern. And, the leveling off of the wave form to a more constant positive 90 volts is attained through the capacitance 12 provided within the convertor circuitry. And, as can also be seen from this FIG. 4, a negative 90 volts appears, as at 14, during each alternating negative cycle of the secondary generated charge. These are not exactly a rectified form of charge, but rather, and as they appear upon the oscilloscope, there has been found to be a form of discharging that occurs within the high intensity discharge lamp itself, after being charged during each alternating cycle within the positive 90 volts potential, and that the negative wave form shown is simply a discharging of the luminaire during each other cycle of operation, and is not a created potential within the operations of the converter.

The Figure demonstrates the negative pulse response of the high pressure sodium arc tube when the gate current is clipped on the SCR. The lamp tube generates this response as if a full wave rectification is taking place through the convertor, but actually, it has been found that this is nothing more than a discharging of the lamp during each cycle of operation, and between the generation of the converted pulsating dc voltages through the operations of the convertor circuitry as located within the ballast secondary.

Numerous variations upon the circuitry of this invention may occur to those skilled in the art upon reviewing the summary of this invention. Such variations or modifications, if within the spirit of this invention, are intended to be encompassed and protected within the scope of any claims to patent protection issuing upon this invention. The description of the preferred embodiment set forth herein is intended for illustrative purposes only.

Having thus described the invention, what is claimed and desired to be secured by Letters Patent is:

1. A converter circuit for use in changing a series wired primary ballast for a mercury vapor lamp circuit to one that can accommodate a high intensity discharge lamp in the category of a high pressure sodium lamp, and therein achieve substantial energy savings during operation of the said high pressure sodium lamp over the corresponding energy consumed during operation of the replaced mercury vapor lamp, comprising, a secondary circuit for the said ballast and having a lamp retaining socket also connected therein, a silicon controlled rectifier connected within the secondary circuit and useful for generating a direct current electrical pulse necessary for energization of such a high intensity discharge lamp, a trigger diode connecting with the gate of the said rectifier and when current conducting providing for a charging of the said rectifier, and a resistor series connected with the said trigger diode and useful for regulating the size of lamp to be accommodated by the converter circuit.

2. The invention of claim 1 and including a capacitor electrically connected between the anode and cathode of the said rectifier and useful for filtering the now rectified generated direct current charge and rendering the incident voltage more constant over the charging period of the said operating rectifier.

3. The invention of claim 2 and wherein said silicon controlled rectifier has an operating range of approximately 200 to 400 volts at 1 to 20 amps of current.

4. The invention of claim 3 and wherein the gate level of the silicon controlled rectifier has an operating range of approximately 0.5 to 3.0 volts at 1 to 40 milliamps of current.

5. The invention of claim 2 and wherein said trigger diode has an operating range of approximately 0.5 to 3.0 volts at 1 to 40 milliamps of current.

6. The invention of claim 2 and wherein the said regulating resistor is selected at a resistance between about 1.75 megaohms to 5.0 megaohms.

7. The invention of claim 2 and wherein the capacitor has a 0.05 microfarad capacitance.

8. The invention of claim 1 and wherein the said converter circuitry can accommodate one of a 150 watt, 100 watt, and 70 watt high pressure sodium lamp.

9. The invention of claim 1 and wherein there is approximately a 40% energy savings during operation of the said high pressure sodium lamp over the corresponding energy consumed during operation of the replaced mercury vapor lamp.

10. The invention of claim 1 and wherein said silicon controlled rectifier comprises a Triac.

* * * * *